United States Patent [19]

Carter

[11] Patent Number: 4,981,271

[45] Date of Patent: Jan. 1, 1991

[54] STUNT KITE STRING WINDER

[76] Inventor: Joel S. Carter, 522 - 26th Ave., Moline, Ill. 61265

[21] Appl. No.: 425,050

[22] Filed: Oct. 23, 1989

[51] Int. Cl.[5] ..... B65H 75/40; B64C 31/06

[52] U.S. Cl. ..... 242/96; 242/85.1; 244/155 A; 244/155 R

[58] Field of Search ..... 242/96, 85.1; 244/155 R, 155 A

[56] References Cited

U.S. PATENT DOCUMENTS

| | | | |
|---|---|---|---|
| 3,138,356 | 6/1964 | McClain | 244/155 |
| 3,143,316 | 8/1964 | Shapiro | 244/155 A |
| 4,172,567 | 10/1979 | Post | 242/96 |
| 4,176,806 | 12/1979 | Kwon | 242/96 |
| 4,653,702 | 3/1987 | McGinnis | 242/96 |
| 4,796,827 | 1/1989 | Munt | 242/96 |
| 4,821,976 | 4/1989 | Nakashima | 242/96 |

OTHER PUBLICATIONS

"Into the Wind", 1989 Kite Catalog, 1989, pp. 14–15.
"Handles and Line by Peter Powell", pp. 4–5.

*Primary Examiner*—Stuart S. Levy
*Assistant Examiner*—Steven M. duBois

[57] ABSTRACT

A stunt kite string winder includes a pair of bracket members which hold a pair of string handles substantially spaced apart and in generally parallel relationship to each other. A crank handle extends from each bracket member so that the winder can be rotated about axis which is located between the string handles. A resilient member biases the brackets towards each other to releasably hold the string handles therebetween.

4 Claims, 3 Drawing Sheets

STUNT KITE STRING WINDER

BACKGROUND OF THE INVENTION

This invention relates to an apparatus for winding kite strings, in particular dual kite strings connected to a stunt-type kite.

It is well known that stunt kites are flown with two fixed lengths of strings, each attached to a separate handle. One method of winding the strings is to wind each string on its own handle, one at a time. This is time consuming and may introduce twist into the kite strings.

Only a few dual string stunt kite winding devices have been proposed. In one such device, each string handle is mounted on pins which project from opposite sides of a central shaft. The central shaft is then revolved by one hand while the strings are separated and/or guided onto the assembled handles and shaft by the other hand. Another dual string stunt kite winding device is described in U.S. Pat. No. 4,653,702 issued in 1987 to McGinnis. In this device both handles are again mounted on pins on opposite sides of a central shaft. A string guide is held radially outwardly from the handles and is supported from a hollow sleeve which slidably and rotatably receives the shaft. A crank handle is fixed to an end of the shaft so that the assembled handles can be rotated to take up the strings. Use of both these dual string winding devices can be time consuming because not much string is taken up for each rotation because the handles are mounted close to each other. Thus, many rotations are required to wind up the standard 150 foot string lengths. It would be desirable to provide a stunt kite string winder which rapidly and simultaneously winds a pair of stunt kite strings.

SUMMARY OF THE INVENTION

An object of the present invention is to provide a stunt kite string winder which is capable of rapidly and simultaneously winding a pair of stunt kite strings onto a pair of string handles.

This and other objects are achieved by the present invention wherein a pair of string handles are removably held in parallel spaced-apart relationship to each other by a pair of bracket members which are releasably coupled to opposite ends of the handles. Each bracket member has a crank handle which is associated with a corresponding one of the string handles and which extends generally away from the corresponding string handle. Preferably, the ends of the string handles are received in blind bores in the brackets to prevent the strings from falling into the joint area between the string handles and the brackets. Alternatively, this function can be achieved by having the ends of the string handles overlapped by string guiding ramp surfaces formed at each end of the brackets. A resilient member biases the bracket members towards each other and so as to releasably hold the string handles therebetween.

DETAILED DESCRIPTION

Figure 1:
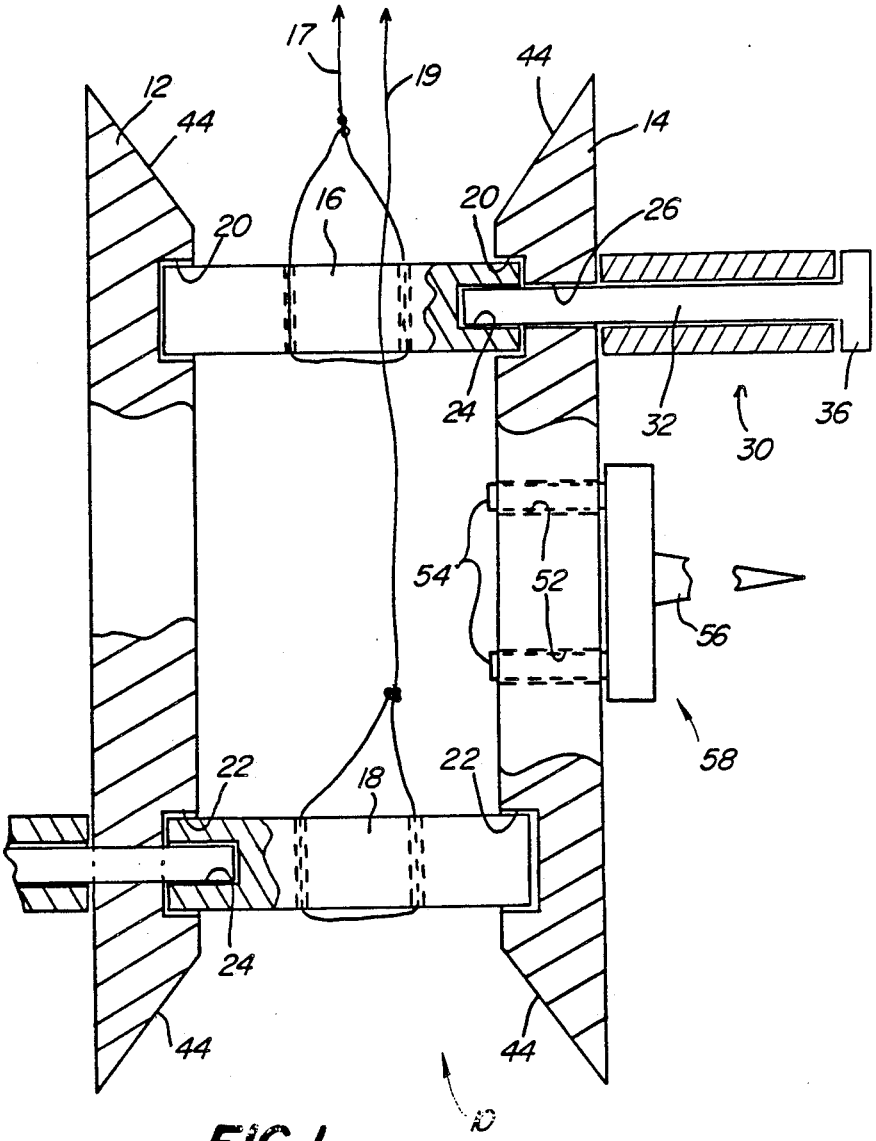
FIG. 1 is a partial sectional view of a stunt kite string winder constructed according to the present invention.

A stunt kite string winder 10 includes a pair of side bracket members 12 and 14 for releasably holding a pair of string handles 16 and 18 therebetween. Stunt kite strings 17, 19 are anchored or tied to a corresponding one of the handles 16, 18. Each bracket member has a pair of spaced apart inwardly facing bores 20, 22 which extend part way therein. Each bore releasably receives an end of one of the string handles so that the handles 14 and 16 are held generally parallel to each other and spaced apart. One end of each handle 16, 18 has a central blind bore 24 extending therein and each bracket member 12, 14 has a hole 26 which extends through the bracket member, intersects the bore 22 and is collinear with bores 20 and 24.

A crank handle 30 is attached near one end of each bracket member 12, 14 so as to project away therefrom in direction generally away from the nearest string handle 16, 18. Each crank handle includes a central shaft 32 upon which is rotatably mounted a sleeve 34. The sleeve 34 is retained on the shaft 32 by an end cap 36.

Figure 2:
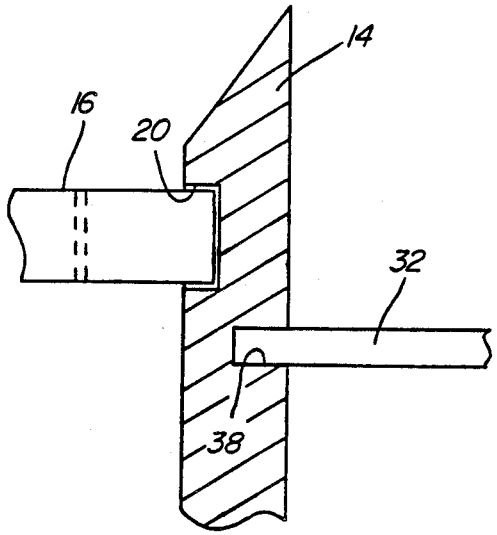
FIG. 2 is a detail partial sectional view of a portion of an alternate embodiment of the present invention.

As seen in FIG. 1, the inner end of the shaft may extend through hole 26, bore 20 and into bore 24. Alternatively, the shaft 32 may only extend into hole 26, whereupon there would be no need for blind bore 24. Also, as best seen in FIG. 2, the shaft 32 may be received by a blind bore which is spaced radially apart from bore 20, again there being no need for a blind bore in the end of string handle 16, 18.

Figure 3:
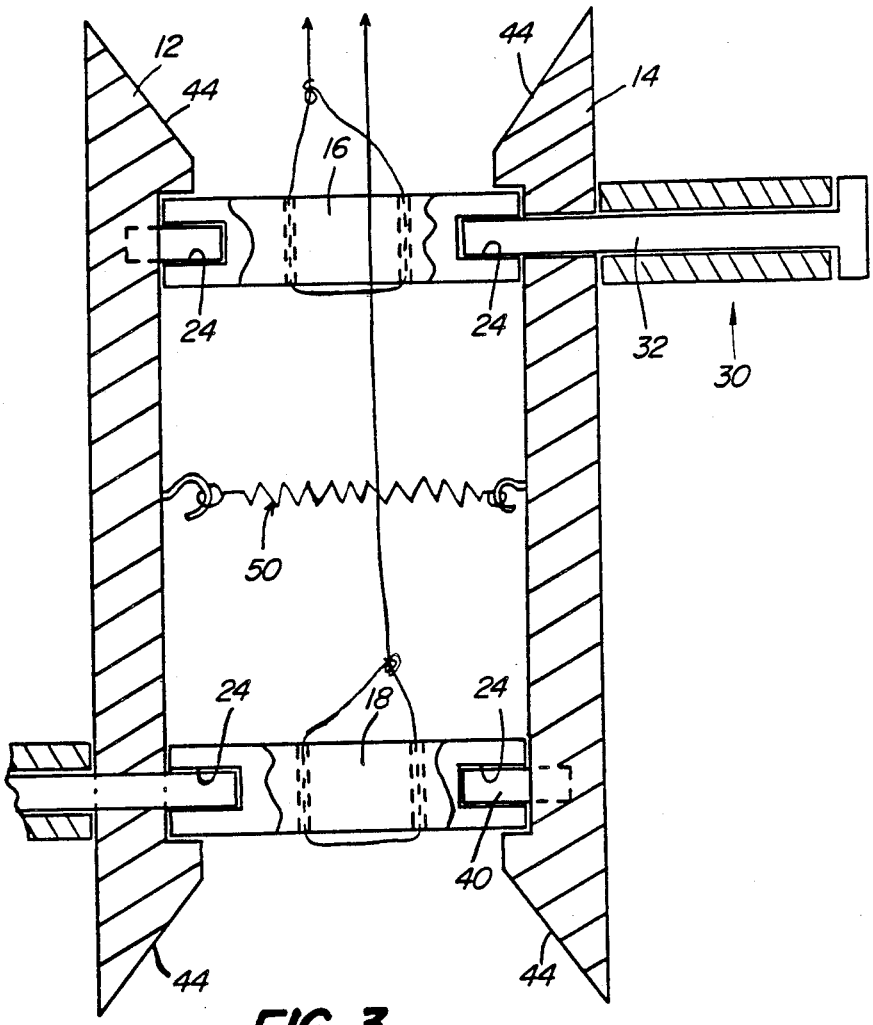
FIG. 3 is a partial sectional view of another alternate embodiment of the present invention.

Also, as seen in FIG. 3, the blind bores 20 can be eliminated, in which case a blind bore 24 should extend into each end of both handles 16, 18 so that the end of each handle 16, 18 may be held in place by a peg 40 or by an end of the shaft 32 of crank handle 30.

A spring member 50 is anchored to the inner side of each bracket member preferably midway between the string handles 16, 18. The spring member is biased to urge the bracket members towards each other and into releasable engagement with the string handles 16, 18. The spring member can be a coil spring as shown in FIGS. 1 and 3 or a common household rubber band can be placed over both bracket members 12, 14. The spring member 50 could be eliminated if a releasable snap or friction fit were used in the connection between shaft 32 and bore 24 and/or between bore 20 and the ends of the string handles 16, 18.

A pair of mounting holes 52 are preferably provided in at least one of the brackets 12, 14 so that the winder assembly can be mounted on the pegs 54 of a staking device 56 which has a shaft 58 which is secured in the ground. This enables the kite flyer to secure the string handles 16, 18 up wind while the kite is prepared for launching.

In each embodiment, each end of both brackets preferably includes a ramp surface 44 which has an inner end which is adjacent to but spaced axially inwardly from a corresponding end of the string handle 16, 18. The ramp surface extends to an outer end which is spaced radially and axially outwardly from the corresponding string handle end. The ramp surfaces 44 serve to guide the strings 17, 19 onto the handles 16, 18 as the winder is rotated and to prevent the strings 17, 19 from getting caught and/or pinched between the handles 16, 18 and the brackets 12, 14.

In each embodiment the elements should be arranged so that the string handles 16, 18 are preferably spaced apart by a distance which is a multiple of the diameter of the string handles. This is because the farther apart are the handles 16, 18, the more string will be wound for each revolution of the winder.

The invention described above operates as follows: When one is finished flying the stunt kite (not shown) the brackets 12, 14 are spread apart from each other so as to stretch the spring member 50, and the handles 16, 18 are mounted between the brackets 12, 14 as shown. One of the brackets is then released so that the tension of spring member 50 will releasably hold the string handles 16, 18 between the bracket members 12, 14. Then each crank handle is grasped by a corresponding hand of the operator and the winder 10 is rotated about an axis which is parallel to the axes of the string handles 16, 18 and which is located between the string handles 16, 18.

When it is desired to unwind the string, the operation just described is reversed.

While the invention has been described in conjunction with a specific embodiment, it is to be understood that many alternatives, modification and variations will be apparent to those skilled in the art in light of the aforegoing description. Accordingly, this invention is intended to embrace all such alternative, modifications and variations which fall within the spirit and scope of the appended claims.

I claim:

1. A stunt kite string winder comprising:

first and second string handles, each having means for attaching a kite string thereto;

a first bracket member;

first means for releasably coupling the first bracket member to a first end of both string handles;

a second bracket member;

second means for releasably coupling the second bracket member to a second end of both string handles, the bracket members and the coupling means cooperating to releasably hold the string handles in spaced-apart, generally parallel relationship to each other;

a first crank handle coupled to the first bracket member near the first string handle and projecting generally away therefrom; and a second crank handle coupled to the second bracket member near the second string handle and projecting generally away from the second string handle, each bracket member having a pair of blind bores extending into one side thereof, and an end of each string handle is releasably received by a corresponding one of the blind bores.

2. A stunt kite string winder comprising:

first and second string handles, each having means for attaching a kite string thereto;

a first bracket member;

first means for releasably coupling the first bracket member to a first end of both string handles;

a second bracket member;

second means for releasably coupling the second bracket member to a second end of both string handles, the bracket members and the coupling means cooperating to releasably hold the string handles in spaced-apart, generally parallel relationship to each other;

a first crank handle coupled to the first bracket member near the first string handle and projecting generally away therefrom;

a second crank handle coupled to the second bracket member near the second string handle and projecting generally away from the second string handle; and a resilient member coupled to the first and second bracket member and biased to urge the bracket members towards each other and towards the string handle.

3. A stunt kite string winder comprising:

first and second string handles, each having means for attaching a kite string thereto;

a first bracket member;

first means for releasably coupling the first bracket member to a first end of both string handles;

a second bracket member;

second means for releasably coupling the second bracket member to a second end of both string handles, the bracket members and the coupling means cooperating to releasably hold the string handles in spaced-apart, generally parallel relationship to each other;

a first crank handle coupled to the first bracket member near the first string handle and projecting generally away therefrom; and a second crank handle coupled to the second bracket member near the second string handle and projecting generally away from the second string handle, each string handle having a pair of bores extending into opposite ends therefrom, each peg being removably receivable by a corresponding one of the bores, a first shaft extending through a bore in the first bracket member, one end of the first shaft forming a first one of the pegs, the other end of the first shaft forming the first crank handle, and a second shaft extending through a bore in the second bracket member, one end of the second shaft forming a second one of the pegs, the other end of the second shaft forming the second crank handle.

4. A stunt kite string winder comprising:

first and second string handles, each having means for attaching a kite string thereto;

a first bracket member;

first means for releasably coupling the first bracket member to a first end of both string handles;

a second bracket member;

second means for releasably coupling the second bracket member to a second end of both string handles, the bracket members and the coupling means cooperating to releasably hold the string handles in spaced-apart, generally parallel relationship to each other;

a first crank handle coupled to the first bracket member near the first string handle and projecting generally away therefrom; and a second crank handle coupled to the second bracket member near the second string handle and projecting generally away from the second string handle, one end of each string handle having a bore extending axially thereinto, each bracket member having a hole extending therethrough, each hole being aligned with a corresponding one of the bores, and each crank handle including a shaft which extends through a corresponding one of the holes and into a corresponding one of the bores.

* * * * *